US005742890A

United States Patent [19]

Kato et al.

[11] Patent Number: 5,742,890

[45] Date of Patent: Apr. 21, 1998

[54] DISCHARGED SHEET STACKING APPARATUS HAVING A PLURALITY OF TRAYS WITH SPACING MEMBERS THEREBETWEEN

[75] Inventors: Katsuhito Kato, Kawasaki; Noriyoshi Ueda, Yokohama, both of Japan

[73] Assignee: Canon Kabushiki Kaisha, Tokyo, Japan

[21] Appl. No.: 745,871

[22] Filed: Nov. 8, 1996

Related U.S. Application Data

[63] Continuation of Ser. No. 363,033, Dec. 23, 1994, abandoned.

[30] Foreign Application Priority Data

Dec. 27, 1993 [JP] Japan ..... 5-354388

[51] Int. Cl.[6] ..... G03G 15/00

[52] U.S. Cl. ..... 399/403; 271/292; 271/293; 399/405

[58] Field of Search ..... 399/403, 404, 399/405, 407; 270/58.01; 271/287, 288, 292–295

[56] References Cited

U.S. PATENT DOCUMENTS

| | | | |
|---|---|---|---|
| 4,328,963 | 5/1982 | DuBois et al. | 271/293 |
| 4,332,377 | 6/1982 | DuBois et al. | 271/293 |
| 4,337,936 | 7/1982 | Lawrence | 271/293 |
| 4,343,463 | 8/1982 | Lawrence | 271/293 |
| 4,466,608 | 8/1984 | DuBois et al. | 271/293 |
| 5,282,611 | 2/1994 | Ueda et al. | 270/53 |
| 5,351,947 | 10/1994 | Aaron | 271/293 |
| 5,384,634 | 1/1995 | Takehara et al. | 355/323 |

*Primary Examiner*—William J. Royer
*Attorney, Agent, or Firm*—Fitzpatrick, Cella, Harper & Scinto

[57] ABSTRACT

A discharged sheet stacking apparatus is provided with a plurality of trays aligned to stack discharged sheets thereon, and a drive member for moving the trays in the alignment direction. Between at least two of the plural trays, a spacer member moved in the alignment direction by the drive device in the same manner as the trays is interposed to widen the space between the trays. The space between the trays can be arbitrarily changed by the spacer member.

24 Claims, 10 Drawing Sheets

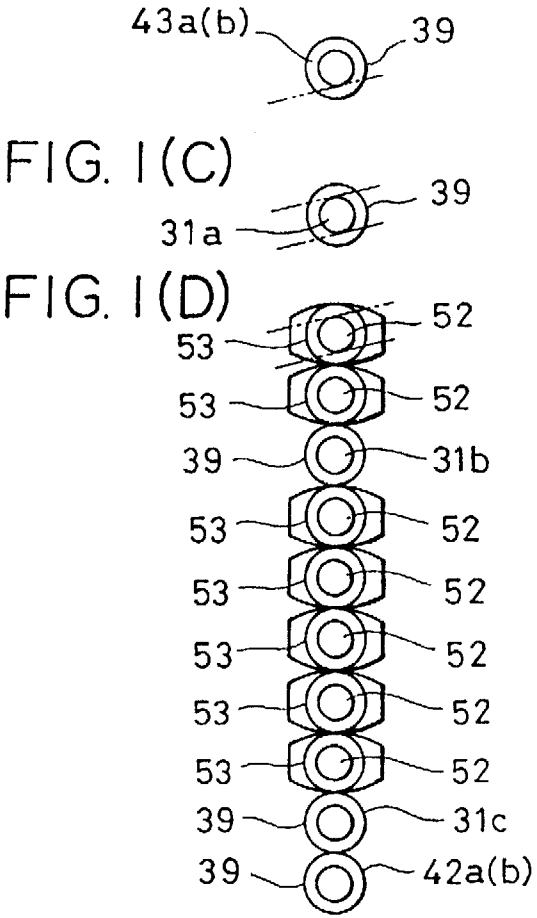
FIG. 1(B)
39
43a(b)
FIG. 1(C)
39
31a
FIG. 1(D)
52
52
31b
52
52
52
52
52
31c
42a(b)
53
53
39
53
53
53
53
53
39
39
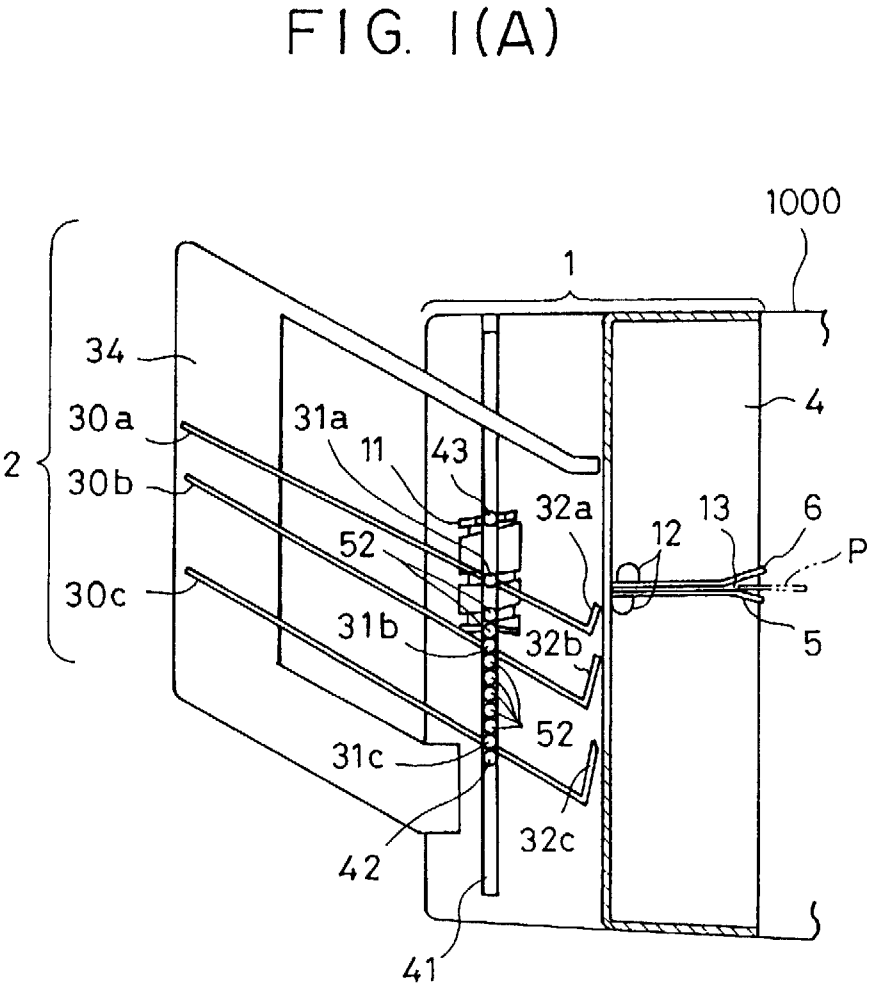
FIG. 1(A)
1000
4
6
P
5
13
12
1
32a
32b
52
32c
43
11
31a
52
31b
31c
42
41
34
30a
30b
30c
2

DISCHARGED SHEET STACKING APPARATUS HAVING A PLURALITY OF TRAYS WITH SPACING MEMBERS THEREBETWEEN

This application is a continuation of application Ser. No. 08/363,033 filed Dec. 23, 1994, now abandoned.

BACKGROUND OF THE INVENTION

1. Field of the Invention

The present invention relates to a discharged sheet stacking apparatus, and, more specifically, to a discharged sheet stacking apparatus mounted in, for example, an image forming apparatus to sort and stack sheets discharged from the image forming apparatus, and even more particularly, to a discharged sheet stacking apparatus having a plurality of trays (sheet stackers) that are movable relative to a fixed transport path.

2. Description of the Related Art

Discharged sheet stacking apparatus are typically equipped with 10 to 20 or more trays (sheet stackers) spaced at regular intervals, and sequentially transport sheets discharged from an image forming apparatus at regular time intervals into predetermined trays by using a transport means, such as a belt, a plurality of rollers, or the combination of the belt and the rollers.

Such discharged sheet stacking apparatus are classified in one of two categories: a movable tray type which moves trays relative to a fixed transport path and a fixed tray type which moves a discharge unit to each of fixed trays or, alternatively, feeds sheets from a fixed main path into each tray by using a flapper (deflecting means).

In the discharged sheet stacking apparatus of the movable tray type, as is well known, each tray is moved to a sheet receiving position so that an inlet of the tray, that is, the space over the tray, is widened. Such type of discharged sheet stacking apparatus are disclosed in, for example, U.S. Pat. Nos. 4,328,963, 4,343,463, 4,466,608, 4,337,936 and 4,332,377.

In discharged sheet stacking apparatus of the movable tray type, the spaces between trays are sequentially widened in a sheet feed-in end by engaging a pair of projecting members mounted at both sides of each tray on the inlet side with a widening mechanism made of a rotary Geneva stop or a lead cam, and all the trays are moved up and down by repeating this widening operation.

FIG. 9 is a side view showing the principal part of a conventional movable tray type discharged sheet stacking apparatus, and FIG. 10 is a view showing the opposite side of the same discharged sheet stacking apparatus.

As shown in the figures, trunnions (referred to as tray rollers) 151*a*, 151*b* and 151*c* respectively mounted at both ends of a plurality of trays B (Ba, Bb and Bc) are guided as they move upward and downward by a pair of right and left guide rails 152. The tray rollers 151*a*, 151*b* and 151*c* engage the grooved cam surfaces of a pair of right and left lead cams (up-and-down drive means) 153*a* and 153*b* at one end thereof, and thereby can be moved upward and downward in correlation to the rotation of the lead cams 153*a* and 153*b* in the directions of the arrows A and D and in the opposite directions.

When the tray rollers 151*a* and 151*b* are positioned in the lead cams 153*a* and 153*b*, as illustrated, the space between the trays Ba and Bb and the space between trays Bb and Bc are locally widened, thereby making it easy for trays Bb and Bc to receive a sheet P discharged from a pair of discharge rollers 155 of an image forming apparatus. The trays B which respectively received sheets P are sequentially stacked at the top or bottom.

At this time, the lead cams 153*a* and 153*b* are designed so as to support the weight of all the trays (tray unit) by the upper surfaces thereof and to move the tray unit upward or downward by one tray roller for each turn of lead cams 153*a* and 153*b*.

However, in the above structure, the outer diameter of the tray roller determines the tray pitch and therefore the tray pitch is at a fixed value in accordance with a cutting face portion of the lead cam or the rotary Geneva stop. Therefore, the pitch of other trays except for trays, whose space therebetween is widened by the widening mechanism, is always constant.

For example, if an image forming apparatus having such discharged sheet stacking apparatus is a complex apparatus functioning as a printer, a facsimile machine and a copying machine, in order to assign the discharge for one of the above functions to a specific tray, the specific tray is required to have a sheet stacking capacity that meets the needs of the selected function. However, since the sheet stacking capacity of the tray is fixed, as mentioned above, that assignment cannot be carried out. Furthermore, if the capacities of other trays are widened in agreement with the capacity of the specific tray, the whole apparatus is enlarged and the cost is increased.

SUMMARY OF THE INVENTION

It is an object of the present invention to provide a discharged sheet stacking apparatus capable of expanding the capacity of a desired tray.

In order to achieve the above object, there is provided a discharged sheet stacking apparatus in which a spacer member for widening the space between at least two of a plurality of trays and being moved upward and downward by an up-and-down drive means is disposed between the trays.

According to the above structure, the space over a desired tray can be widened and the sheet stacking capacity of the tray can be increased by interposing the spacer member between the tray and another tray. Since the required sheet stacking capacity of a tray can be obtained without enlarging the whole apparatus, it is possible to reduce the cost of the apparatus and to have it be ready for a complex image forming apparatus.

Furthermore, productivity of the image forming apparatus can be increased by adding trays used for sorting and grouping.

In accordance with these objects, there is provided a discharged sheet stacking apparatus for sorting and stacking discharged sheets, the apparatus comprising a plurality of trays having a space between each adjacent pair of trays and aligned in a direction to stack thereon a discharged sheet, a spacer member interposed between at least two of the plural trays to widen the space between the trays and drive means for moving the trays in the alignment direction, wherein the drive means moves the spacer member in the alignment direction to widen the space between the trays.

In accordance with another aspect of the present invention, there is provided image forming means for forming an image on a sheet in accordance with one of a copy mode, a facsimile mode and a print mode, and for discharging the sheet on which the image has been formed; a plurality of trays having a space between each adjacent pair of trays and aligned in an alignment direction to stack thereon the discharged sheets; a spacer member interposed between at least two of said plural trays to widen the space between said two trays; and drive means for moving said trays in the alignment direction, wherein said drive means moves said spacer member in the alignment direction to widen the space between said trays, and wherein the sheets are discharged into said trays in accordance with the mode in which the image is formed.

These and other objects of the invention will become apparent to those of ordinary skill in view of the following detailed description.

BRIEF DESCRIPTION OF THE DRAWINGS

FIG. 1(A) is a sectional side view of a discharged sheet stacking apparatus according to a first embodiment of the present invention;

FIG. 1(B) is a cross sectional view of an upper guide pin in the first embodiment of the present invention;

FIG. 1(C) is a cross sectional view of a trunnion in the first embodiment of the present invention;

FIG. 1(D) is a cross sectional view illustrating the stacking of trunnions in the first embodiment of the present invention;

DESCRIPTION OF THE PREFERRED EMBODIMENTS

Preferred embodiments of the present invention will be described with reference to the drawings.

[Embodiment 1]

Figure 2:
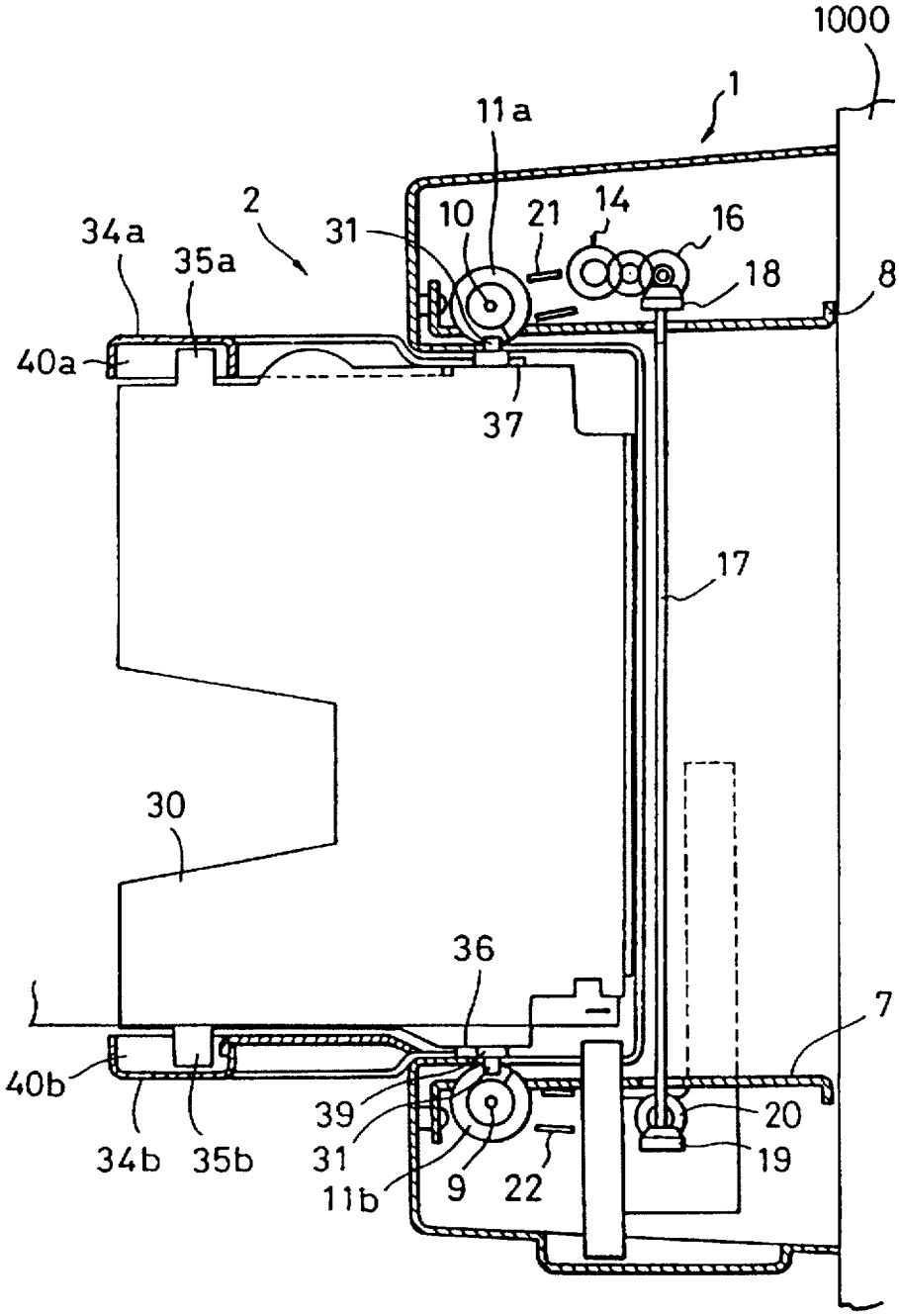
FIG. 2 is a sectional plan view of the discharged sheet stacking apparatus.
Figure 3:
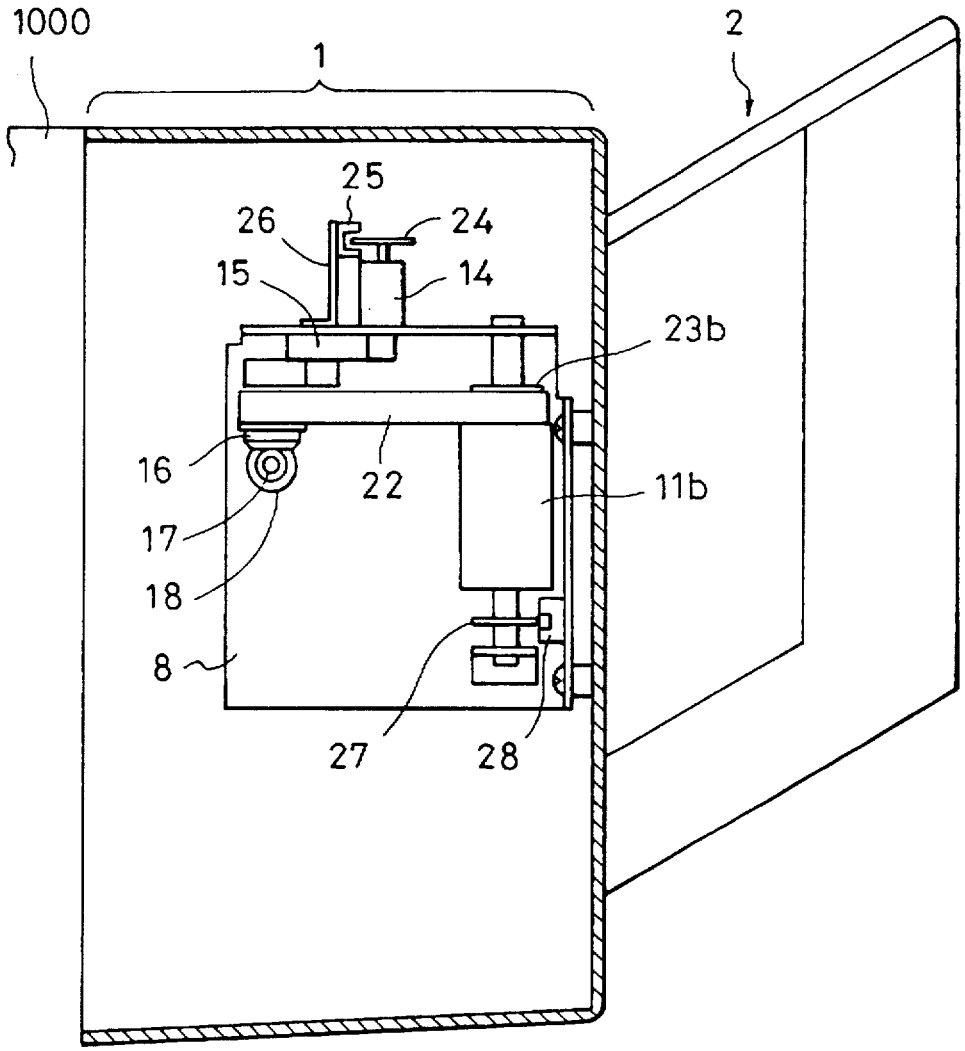
FIG. 3 is another sectional side view of the discharged sheet stacking apparatus.
Figure 4A:
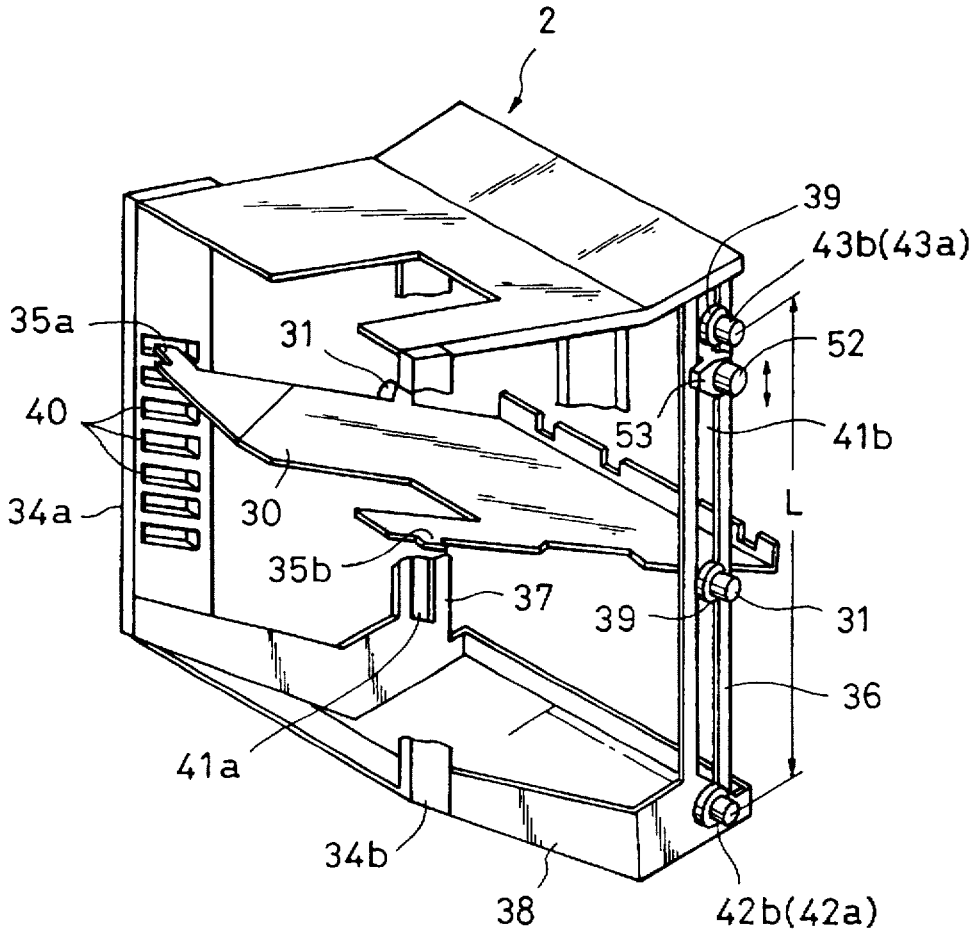
FIG. 4(A) is a partially cutout perspective view of the discharged sheet stacking apparatus.
Figure 4B:
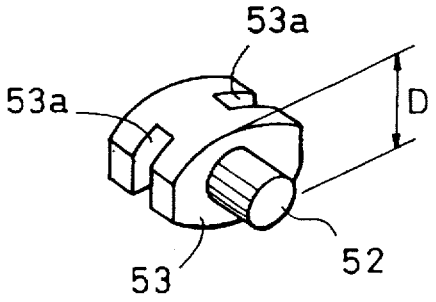
FIG. 4(B) is an enlarged illustration of a dummy trunnion of FIG. 4(A)

FIG. 1 is a sectional side view of a discharged sheet stacking apparatus according to a first embodiment of the present invention, FIG. 2 is a sectional plan view of the discharged sheet stacking apparatus, FIG. 3 is another sectional side view of the discharged sheet stacking apparatus, and FIGS. 4(A) and 4(B) are partially cutout perspective views of the discharged sheet stacking apparatus.

As shown in the figures, the discharged sheet stacking apparatus encompasses a sorter main unit 1 and a tray unit 2.

The sorter main unit 1 is equipped with a frame 4 integrally formed with a lower guide 5, an upper guide 6 opposing to lower guide 5, front and rear side plates 7 and 8 (in FIG. 2) mounted on concave portions of the frame 4, lead cams (up-and-down drive means) 11 (11*b* and 11*a*) attached to the front and rear side plates 7 and 8 and rotatably on shafts 9 and 10, and a pair of transport rollers 12 supported by the upper and lower guides 5 and 6.

A sheet sensor (not shown) for detecting a sheet P is disposed near the sheet discharge end of sheet transport path 13 (in FIG. 1), and consists of a photosensor and an actuator. In this embodiment, the passage time of the sheet P and the distance between the sheet P and the next sheet can be measured by the sheet sensor, and a detection signal from the sheet sensor is transmitted to a microcomputer in the sorter main unit 1.

The rear side plate 8 is provided with a forward and reverse rotatable shift motor 14 (in FIGS. 2 and 3) whose driving force is transmitted to a bevel gear 16 integrally formed with a pulley through a train of driving gears 15, and then from the bevel gear 16 to the lead cam 11*a* through a belt 21. A bevel gear 18 (in FIG. 2) fixed at one end of a through shaft 17 engages bevel gear 16, and a bevel gear 19 fixed at the other end of the through shaft 17 engages a bevel gear 20 integrally formed with pulley 23*b*. Pulley 23*b* is integrally formed with the lead cam 11*b* through a belt 22. When the shift motor 14 is rotated forward and backward, the lead cams 11 are also rotated forward and backward by means of a drive transmission system having the above structure.

A clock disk 24 (in FIG. 3) is fixed to an output shaft of the shift motor 14, and the number of rotations of the shift motor 14, that is, the number of rotations of the lead cams 11 can be measured by a photointerrupter 25 held on the rear side plate 8 through a sensor holder 26. The number of rotations of the lead cams 11 is controlled by a shift motor control circuit (not shown) in the sorter main unit 1. A flag 27 for detecting the position of the lead cams 11 is coaxially mounted below the lead cam 11*a*, and a photosensor 28 for reading the detection of the flag 27 is fixed to the rear side plate 8. Each of the lead cams 11 has a horizontal portion (about 180°) and the flag 27 is fan-shaped at an angle of 180° so as to detect the above horizontal portion in this embodiment. One rotation of the lead cams 11 allows one tray to be shifted.

On the other hand, the tray unit 2 includes three trays 30 (30*a* to 30*c*) each for stacking the sheet P discharged by the transport rollers 12 (in FIG. 1) thereon. Each of the trays 30 has trunnions 31 (31*a* to 31*c*) at both ends of a base portion thereof to engage with spiral cam surfaces of the lead cams 11, and tongue portions 35*a* and 35*b* in a leading portion to engage with separators 34 (34*a* and 34*b*) by grooves 40 (40*a* and 40*b*) (in FIGS. 2 and 4). The tray 30 is supported by front and rear support plates 36 and 37 respectively having trunnion guides 41 (41*a* and 41*b*), and a tray frame 38 integrally formed with the separators 34 (34*a* and 34*b*), and is equipped with support portions 39 having a predetermined outer diameter and mounted coaxially with the trunnions 31 as shown in FIG. 2. The space between the trays 30 whose trunnions 31 are not engaged with the lead cams 11 is basically determined by the outer diameter of the support portions 39 and the pitch of grooves 40 (40*a* and 40*b*) formed on the separators 34.

Two dummy trunnions (spacer members) 52 are mounted on each side between the trunnion 31*a* of the first (uppermost) tray 30*a* and the trunnion 31*b* of the second tray 30*b* (only one trunnion 52 is illustrated in FIG. 4). Furthermore, five dummy trunnions 52 are mounted on each side between the trunnion 31*b* of the second tray 30*b* and the trunnion 31*c* of the third tray 30*c* (FIG. 1(D)). Each of the dummy trunnions 52 coaxially has a support portion 53 having the same predetermined outer diameter D (see FIG. 4(B)) as the support portion 39 of the tray 30. The dummy trunnion 52 also has rough guides 53*a* to be engaged with the trunnion guides 41 (41*a* and 41*b*) of the support plates 36 and 37 so as to smoothly slide along the support plates 36 and 37. Needless to say, the trunnions 31 and the support portions 39 may have the same diameter. The combination of the trunnion 31 and the support portion 39 is generally referred to as a trunnion. The trunnion 31 is dropped and mounted into the trunnion guide 41 independently or together with the tray 30 from above the apparatus. Therefore, the guide portion 41 is open at the top thereof. Lower guide pins 42 (42*a* and 42*b*) are fixed to the bottoms of the trunnion guides 41 of the support plates 36 and 37, and upper guide pins 43 (43*a* and 43*b*) are respectively screwed in the trunnion guides 41 at a predetermined distance L above from the lower guide pins 42. Since the upper guide pins 43 can slide along mount grooves because of their layered mount surfaces, the distance L can be adjusted by shifting the screwing position of the upper guide pins 43. The adjustment of the distance L in such manner allows scoop portions at the bottoms of the lead cams 11 to smoothly scoop up the trunnions 31 of the trays 30 10 while preventing the scoop portions from being in contact with the thick of the trunnion 31. The dummy trunnions 52 are moved upward and downward while being scooped up by the lead cams 11 in the same manner as the trunnions 31.

In this embodiment, the sheet stacking spaces of the second and third trays 30*b* and 30*c*, that is, the spaces over the second and third trays 30*b* and 30*c* in a state in which the sheet P is ready to be discharged into the first tray 30*a* can be made three or six times as wide as before by the dummy trunnions 52. Furthermore, since sheet receiving portions 32*a* to 32*c*, which are high with respect to the capacity of the trays 30, are mounted on the trays 30, it is possible to increase the number of sheets that may be stacked.

The discharged sheet stacking apparatus of this embodiment is mounted on an image forming apparatus 1000 for performing the functions of a copying machine, a facsimile machine and a printer, and copy sheets, facsimile sheets and printing sheets are respectively discharged into the first, second and third trays 30*a*, 30*b* and 30*c*. In this case, the trays 30*a* to 30*c* are referred to as function trays. Needless to say, it is possible to distribute sheets in a sorting mode (to shift the trays 30*a* to 30*c* every time when one sheet is discharged) by using the trays 30*a* to 30*c*.

Figure 5:
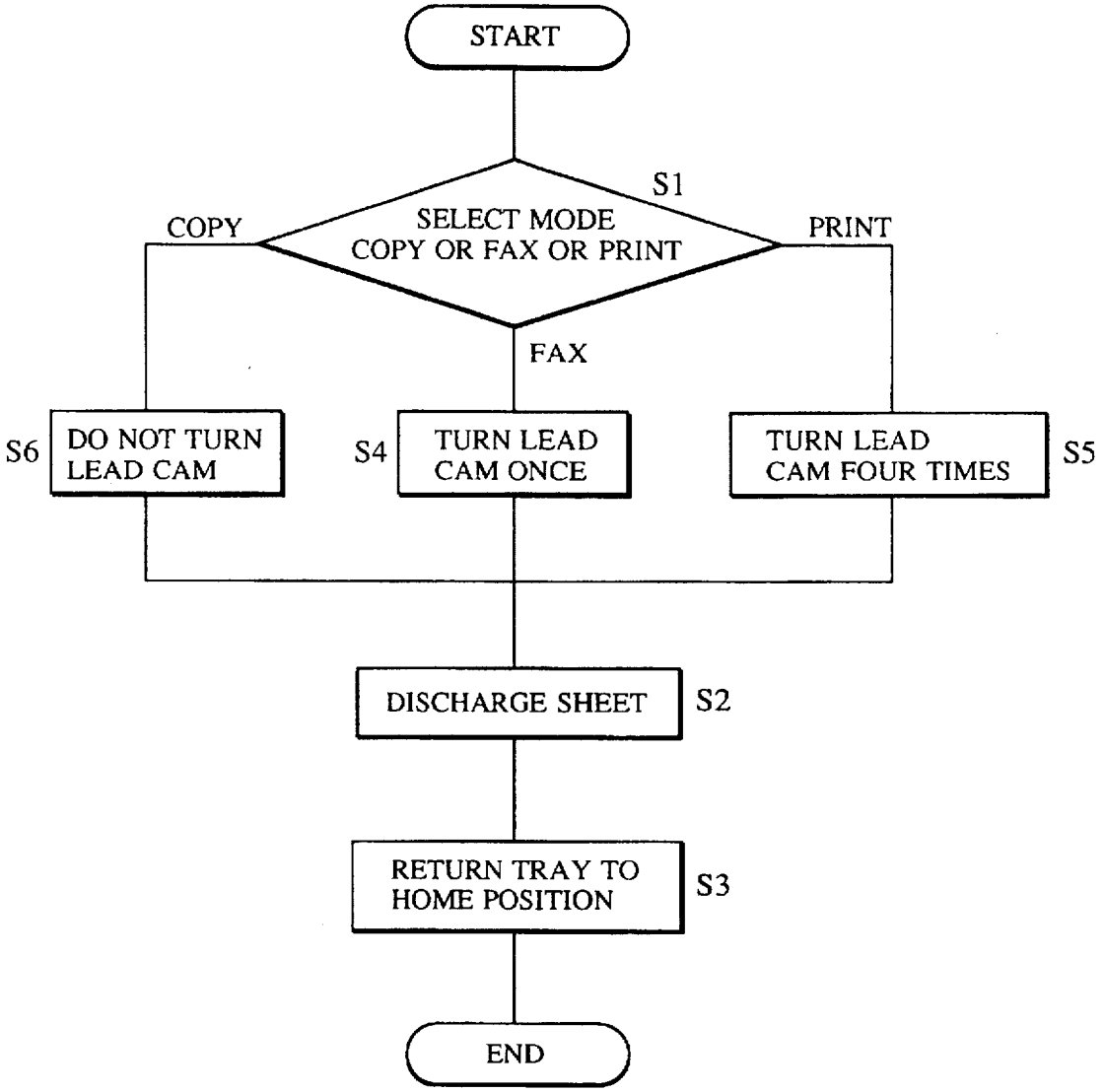
FIG. 5 is a flowchart explaining operations of the discharged sheet stacking apparatus.

Operations of the discharged sheet stacking apparatus mounted on the image forming apparatus 1000 will now be described by reference to the flowchart of FIG. 5.

When the image forming apparatus 1000 is started and a copy mode is selected (S1), the lead cams 11 do not move (S6) and sheet P is directly discharged into the first tray 30*a* (S2). The positions of the trays 30*a* to 30*c* at this time are regarded as home positions (return to home position, S3).

When a fax mode is selected (S1), the lead cams 11 make one turn (S4), the first tray 30*a* is thereby raised, the second tray 30*b* is moved to a sheet discharge position, and a sheet P is discharged (S2). When the sheet discharge is completed, the lead cams 11 make one reverse turn, and the second tray 30*b* returns to the home position together with the first tray 30*a*.

When a print mode is selected (S1), the lead cams 11 make four turns (S5), the first tray 30*a*, the two dummy trunnions 52 and the second tray 30*b* are thereby raised, the third tray 30*c* is moved to the sheet discharge portion, and a sheet P is discharged (S2). After the sheet P is discharged, the trays 30*a* to 30*c* return to the respective home positions (S3).

In the discharged sheet stacking apparatus having the above structure, a sufficiently large sheet stacking capacity can be secured in the fax mode and the print mode, particularly the print mode. Therefore, the apparatus can operate unattended in the fax mode. Furthermore, since sheets are discharged into the second tray 30*b* in the fax mode, they are hard to see from outside in the shadow of the first tray 30*a*, and data security can be ensured.

[Embodiment 2]

Figure 6:
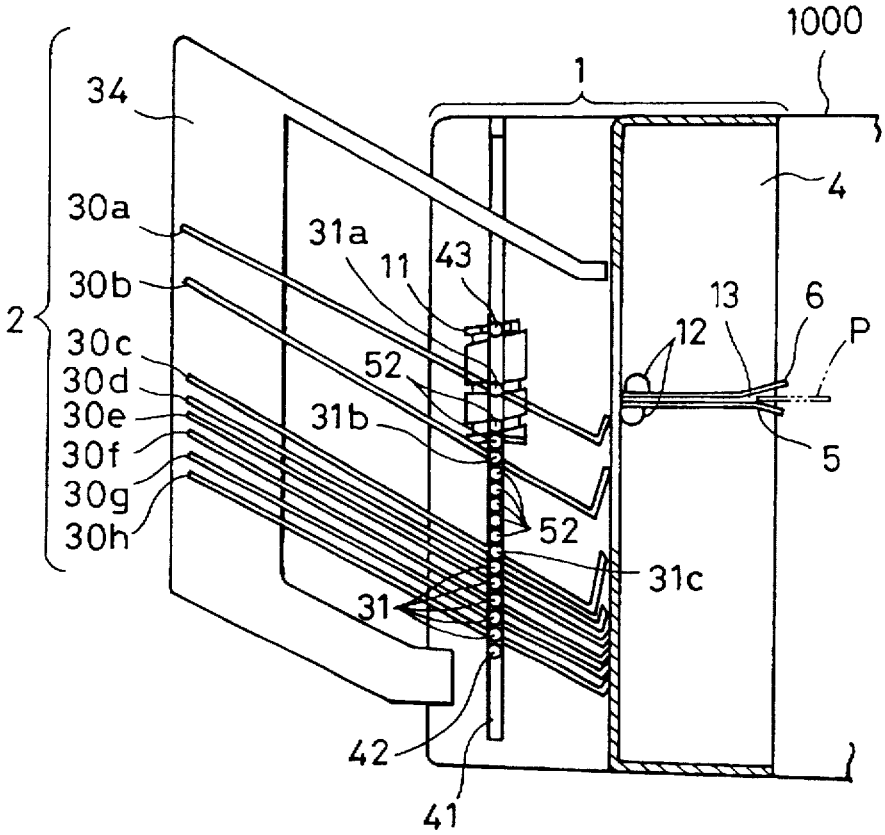
FIG. 6 is a sectional side view of a discharged sheet stacking apparatus according to a second embodiment of the present invention.

FIG. 6 is a sectional side view of a discharged sheet stacking apparatus according to a second embodiment of the present invention.

The discharged sheet stacking apparatus of this embodiment has sheet sorting and grouping functions as well as the same advantages as those of the first embodiment.

In this embodiment, a sorter main unit 1 has eight trays from the first (uppermost) tray 30*a* to the eighth (bottommost) tray 30*h*. The first tray 30*a* stacks copy sheets thereon in a non-sort mode, and the second and third trays 30*b* and 30*c* respectively stack fax sheets and print sheets thereon in the same manner as the first embodiment. Five trays from the fourth tray 30*d* to the eighth tray 30*h* stack sheets for a sort mode and a group mode. Dummy trunnions 52 are disposed in the same manner as in the first embodiment.

Figure 7:
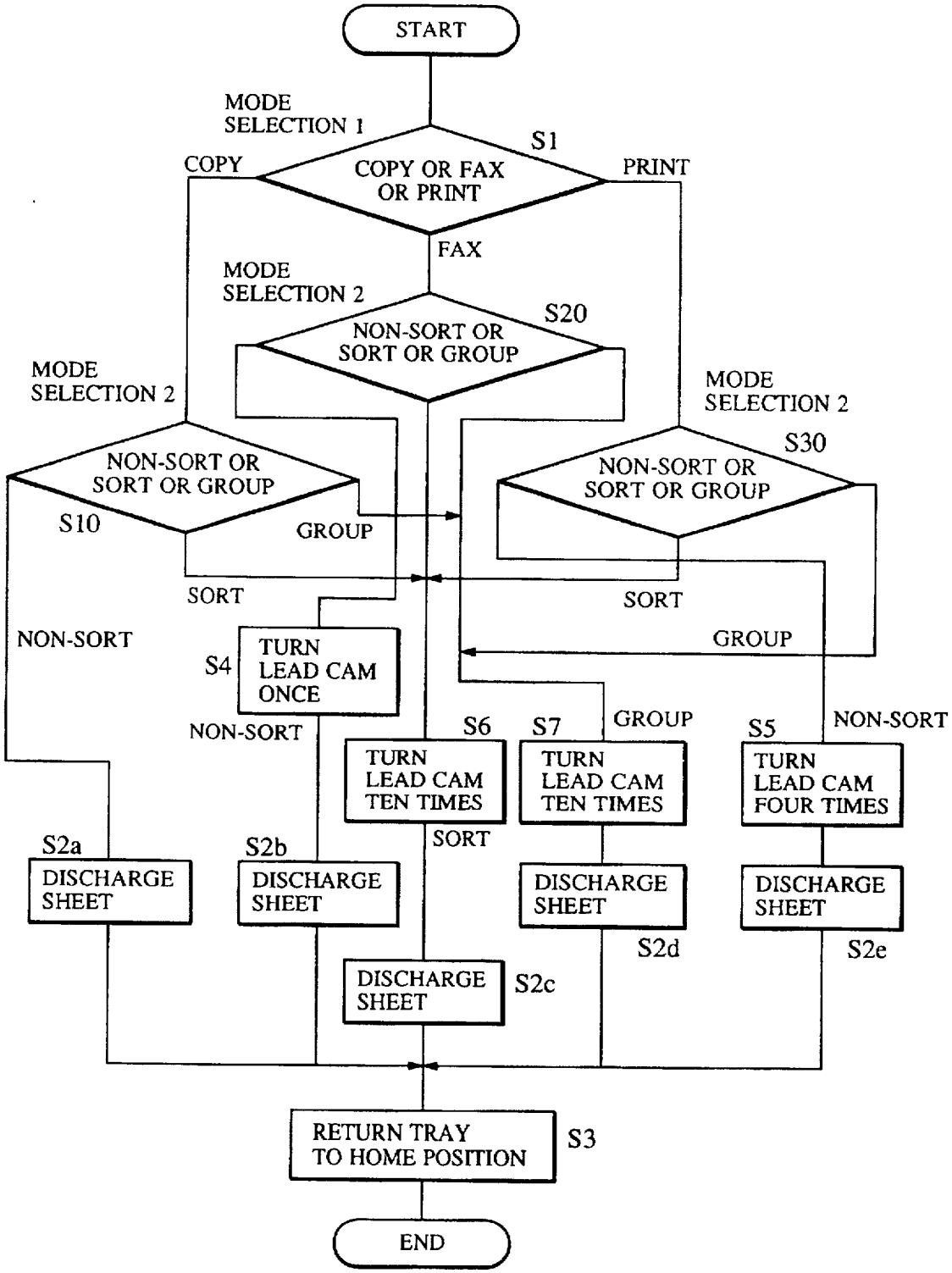
FIG. 7 is a flowchart explaining operations of the discharged sheet stacking apparatus.

Operations of the discharged sheet stacking apparatus mounted in a multi-function image forming apparatus 1000 will now be described with reference to a flowchart of FIG. 7.

When the image forming apparatus 1000 is started, one of copy, fax and print modes is selected in mode selection 1 (S1) and a non-sort mode is selected in mode selection 2 (S10, S20 or S30), the same operation as that of the first embodiment is performed (S2*a* to S3, S4 to S2*b* to S3, S5 to S2*e* to S3).

When a sort mode or a group mode is selected in the mode selection 2 (S10, S20 or S30), the lead cams 11 make ten turns from the home position (S6 or S7), and sheets P are discharged into the fourth tray 30*d*. The positions of the trays 30 in this state are regarded as home positions in the sort mode or the group mode. The trays 30 are shifted by one tray in every turn of the lead cams 11, and a sorting or grouping operation is performed by using the fourth to eighth trays 30*d* to 30*h*. These trays 30*d* to 30*h* are referred to as sort mode trays or group mode trays. Needless to say, the trays 30*c* to 30*h* or the trays 30*a* to 30*h* may be used in the sort mode.

In the discharged sheet stacking apparatus of this embodiment, since one turn of the lead cams 11 shifts the trays 30 by one tray as described above, the shift operation can be speedily performed even if the interval between sheets is short. Therefore, high productivity can be achieved in the image forming apparatus.

The insertion position and number of the dummy trunnions are not limited to those in the above embodiments. The spiral cam means like the lead cams 11 may be replaced with a rotary Geneva means as disclosed in U.S. Pat. No. 4,328,963.

The image forming apparatus may have a complex function of fax and print, fax and copy, or copy and print. The construction of such an image forming apparatus will be described with reference to FIG. 8.

Figure 8:
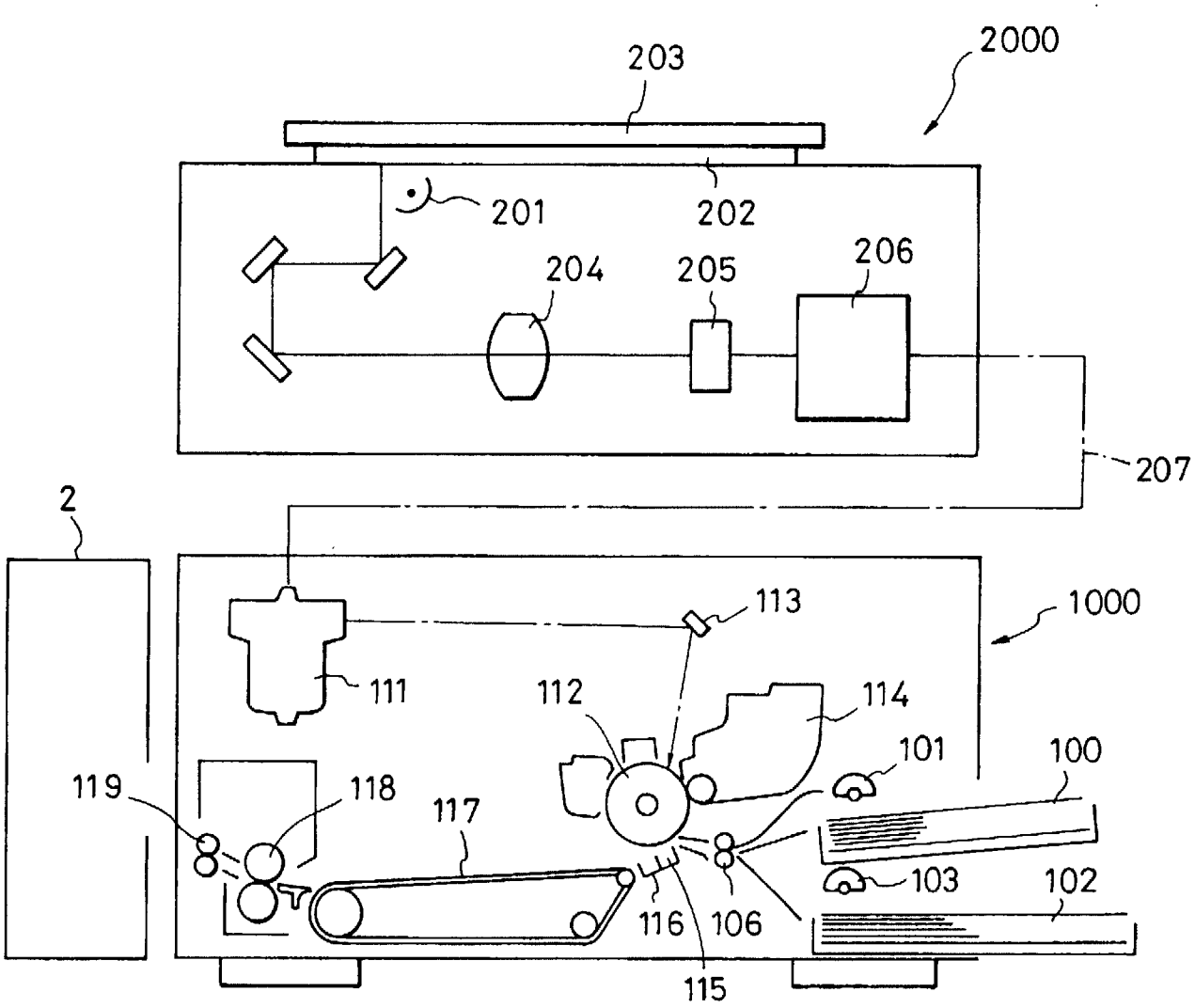
FIG. 8 is a sectional front view of an image forming apparatus.
Figure 9:
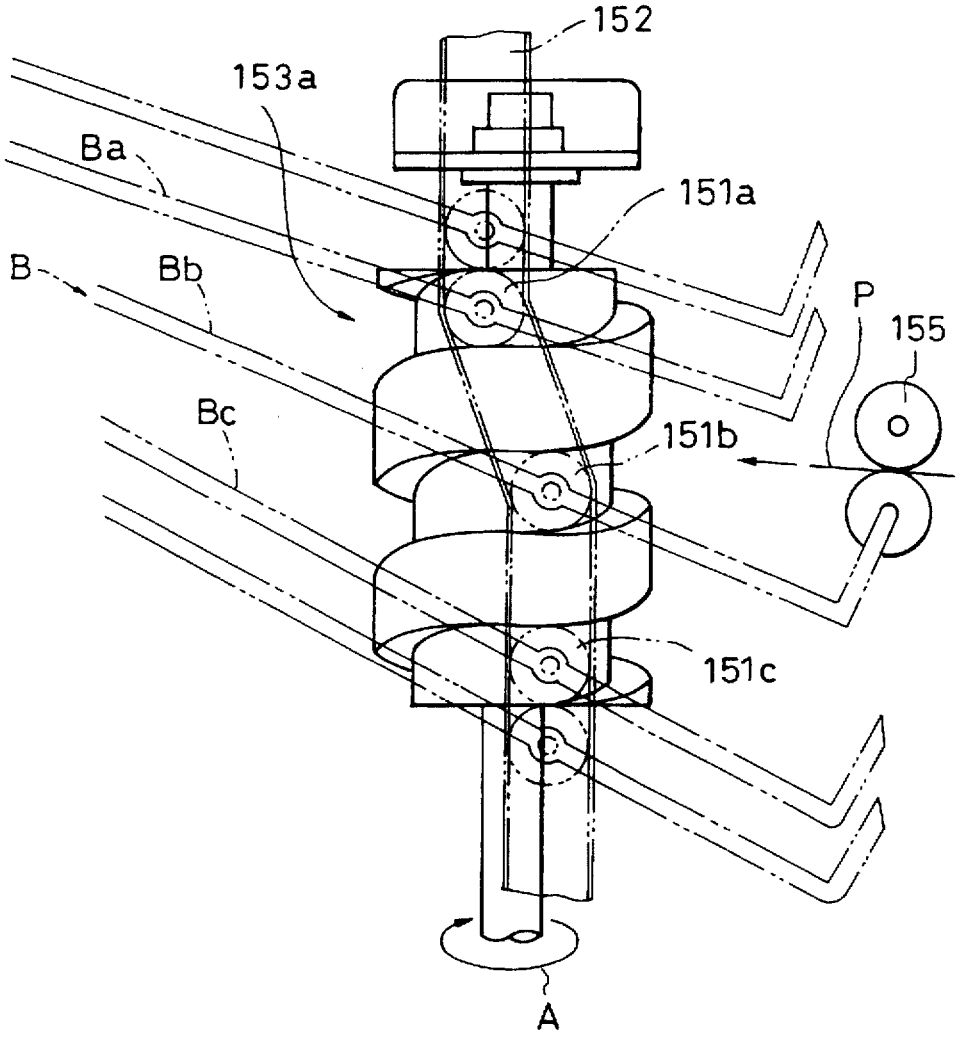
FIG. 9 PRIOR ART
FIG. 9 is a side view showing the principal part of a conventional discharged sheet stacking apparatus.
Figure 10:
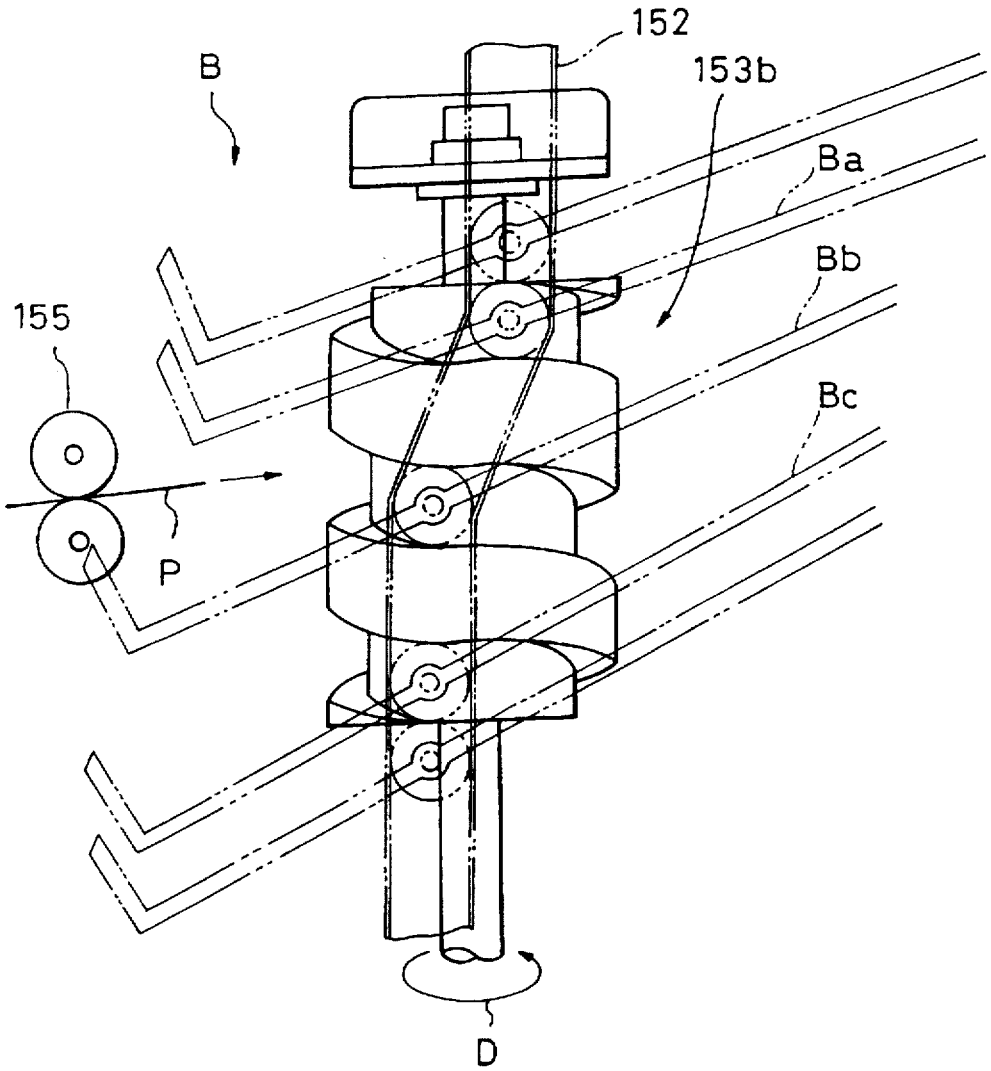
FIG. 10 PRIOR ART
FIG. 10 is a side view showing the other side of the conventional discharged sheet stacking apparatus.

Referring to FIG. 8, in a printer 1000, sheets in an upper cassette 100 are separated and fed one by one by the action of a separating claw and a feed roller 101, and led to register rollers 106. Sheets in a lower cassette 102 are separated and fed one by one by the action of a separating claw and a feed roller 103, and led to the register rollers 106.

A laser modulator (laser scanner) 111, a photo-conductive drum 112, an image writing optical system 113, a developing device 114, a transfer charger 115 and a separating charger 116 constitute an image forming portion.

Numerals 117, 118 and 119 respectively denote a transport belt for transporting a sheet having an image thereon, a fixing device and discharge rollers. The sheet having the image is discharged to the sorter main unit 2 by the discharge rollers 119.

A scanner 2000 is comprised of a scanning light source 201, a platen glass 202, a movable document platen 203, a lens 204, a photoreceptor (photoelectric converter) 205 and an image processing unit 206.

A document image scanned by the scanning light source 201 is processed by the image processing unit 206, converted into electric signals 207, and transmitted to the laser modulator 111.

Although the printer 1000 and the scanner 2000 are separate in FIG. 8, they may be combined into one. The combination is generally referred to as an image forming apparatus (or printer).

In each case, the printer 1000 functions as a copying machine when the laser modulator 111 receives process signals of the image processing unit 206, functions as a facsimile machine when receiving fax transmission signals, and functions as a printer when receiving output signals from a personal computer. When process signals of the image processing unit 206 are transmitted to another facsimile machine, the printer 1000 functions as a facsimile machine.

Document images can be automatically scanned through the use of an automatic document feeder instead of the document platen 203.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A discharged sheet stacking apparatus for sorting and stacking discharged sheets, comprising:

a plurality of trays, each of said trays having a trunnion and being aligned in an alignment direction to stack thereon the discharged sheets;

rotation means, said rotation means having a spiral cam to be engaged with said trunnions and rotating to move each of said trays in the alignment direction through said trunnions; and a dummy trunnion, said dummy trunnion being interposed between at least two of said trunnions to widen the space between at least two of said trays more than spaces between other trays and engaging with said spiral cam of said rotation means to move in the alignment direction in the same manner as said trunnions.

2. A discharged sheet stacking apparatus according to claim 1, wherein each of said trunnions has a trunnion portion engaging with the spiral cam and a support portion for keeping the space between at least two of said trays in contact with other support portions of other trunnions, and said dummy trunnion has a trunnion portion engaging with said spiral cam and a support portion in contact with said support portion of said trunnions.

3. A discharged sheet stacking apparatus according to claim 1, wherein said plurality of trays is three trays.

4. A discharged sheet stacking apparatus according to claim 1, wherein said plurality of trays is at least four trays.

5. A discharged sheet stacking apparatus according to claim 1, wherein a number of said dummy trunnions for each of the spaces between the trays is differentiated from one another, so that the spaces between the trays are differentiated from one another.

6. An image forming apparatus, comprising:

image forming means for forming an image on a sheet in accordance with one of a copy mode, a facsimile mode and a print mode, and for discharging the sheet on which the image has been formed;

a plurality of trays having a space between each adjacent pair of trays and aligned in an alignment direction to stack thereon the discharged sheets;

a spacer member interposed between at least two of said plurality of trays to widen the space between said two trays; and drive means for moving said trays in the alignment direction, wherein said drive means moves said spacer member in the alignment direction to widen the space between said trays, wherein the sheets are discharged into said trays in accordance with the mode in which the image is formed.

7. An image forming apparatus, comprising:

image forming means for forming an image on a sheet in accordance with one of a copy mode, a facsimile mode and a print mode, and for discharging the sheet on which the image has been formed;

a plurality of trays having a space between each adjacent pair of trays and aligned in an alignment direction to stack thereon the discharged sheets;

a spacer member interposed between at least two of said plurality of trays to widen the space between said two trays; and drive means for moving said trays in the alignment direction, wherein said drive means moves said spacer member in the alignment direction to widen the space between said trays, wherein the sheets are discharged into said trays in accordance with the mode and said trays are ready for a sort mode.

8. An image forming apparatus, comprising:

image forming means for forming an image on a sheet and discharging the sheet;

a discharged sheet stacking unit for sorting and stacking discharged sheets on which images are formed, said discharged sheet stacking unit including:

a plurality of trays, each of said trays having a trunnion and being aligned in an alignment direction to stack thereon the discharged sheets;

rotation means, said rotation means having a spiral cam engaged with each of said trunnions and rotating to move each of said trays in the alignment direction through said trunnions; and a dummy trunnion, said dummy trunnion being interposed between at least two of the trunnions to widen a space between at least two of said trays more than spaces between other trays and engaging with said spiral cam of said rotation means to move in the alignment direction in the same manner as said trunnions.

9. An image forming apparatus according to claim 8, wherein each of said trunnions has a trunnion portion engaging with said spiral cam and a support portion for keeping the space between at least two of said trays in contact with other support portions of other trunnions, and said dummy trunnion has a trunnion portion engaging with said spiral cam and a support portion in contact with said support portion of each of said trunnions.

10. An image forming apparatus according to claim 8, wherein said image forming means forms images generated in accordance with one of a plurality of input sources, and wherein said plurality of trays receive said discharged sheets in accordance with the input source.

11. An image forming apparatus according to claim 10, wherein said apparatus includes a sort mode and said plurality of trays include a first group of trays that receive said discharged sheets in accordance with the input source and a second group of trays into which sheets are discharged when said apparatus is operating in the sort mode.

12. An image forming apparatus according to claim 8, further comprising a copy mode, a facsimile mode, and a print mode, wherein a tray is selected in accordance with each of the modes and discharged sheets are stacked thereon, and a number of said dummy trunnions for each of the spaces between said trays is differentiated from one another, so that capacity of sheet stacking of each of said trays is differentiated from one another.

13. A discharged sheet stacking apparatus for sorting and stacking discharged sheets, comprising:

a plurality of trays, each of said trays having a trunnion and being aligned in an alignment direction to stack thereon the discharged sheets;

rotation means, said rotation means having a spiral cam to be engaged with said trunnions and rotating to move each of said trays in the alignment direction through said trunnions; and a spacer trunnion, said spacer trunnion being interposed between at least two of said trunnions to widen the space between at least two of said trays and engaging with said spiral cam of said rotation means to move in the alignment direction in the same manner as said trunnions.

14. A discharged sheet stacking apparatus according to claim 13, wherein each of said trunnions has a trunnion portion engaging with the spiral cam and a support portion for keeping the space between at least two of said trays in contact with other support portions of other trunnions, and said spacer trunnion has a trunnion portion engaging with said spiral cam and a support portion in contact with said support portion of said trunnions.

15. A discharged sheet stacking apparatus according to claim 14, wherein said plurality of trays comprise at least three trays.

16. A discharged sheet stacking apparatus according to claim 13, wherein said plurality of trays comprise at least four trays.

17. A discharged sheet stacking apparatus according to claim 13, wherein a number of said spacer trunnions for each of the spaces between the trays is differentiated from one another, so that the spaces between the trays are differentiated from one another.

18. An image forming apparatus, comprising:

image forming means for forming an image on a sheet in accordance with one of a plurality of modes, and for discharging the sheet on which the image has been formed;

a plurality of trays having a space between each adjacent pair of trays and aligned in an alignment direction to stack thereon the discharged sheets;

a spacer member interposed between at least two of said plurality of trays to widen the space between said two trays; and drive means for moving said trays in the alignment direction, wherein said drive means moves said spacer member in the alignment direction to widen the space between said trays, and wherein the sheets are discharged into said trays in accordance with the mode in which the image is formed.

19. An image forming apparatus according to claim 18, wherein said plurality of modes are a copy mode, a facsimile mode, and a print mode.

20. An image forming apparatus, comprising:

image forming means for forming an image on a sheet and discharging the sheet; and a discharged sheet stacking unit for sorting and stacking discharged sheets on which images are formed, said discharged sheet stacking unit including:

a plurality of trays, each of said trays having a trunnion and being aligned in an alignment direction to stack thereon the discharged sheets;

rotation means, said rotation means having a spiral cam engaged with each of said trunnions and rotating to move each of said trays in the alignment direction through said trunnions; and a spacer trunnion, said spacer trunnion being interposed between at least two of the trunnions to widen a space between at least two of said trays and engaging with said spiral cam of said rotation means to move in the alignment direction in the same manner as said trunnions.

21. An image forming apparatus according to claim 20, wherein each of said trunnions has a trunnion portion engaging with said spiral cam and a support portion for keeping the space between at least two of said trays in contact with other support portions of other trunnions, and said spacer trunnion has a trunnion portion engaging with said spiral cam and a support portion in contact with said support portion of each of said trunnions.

22. An image forming apparatus according to claim 20, wherein said image forming means forms images generated in accordance with one of a plurality of input sources, and wherein said plurality of trays receive said discharged sheets in accordance with the input source.

23. An image forming apparatus according to claim 21, wherein said apparatus includes a sort mode and said plurality of trays include a first group of trays that receive said discharged sheets in accordance with the input source and a second groups of trays into which sheets are discharged when said apparatus is operating in the sort mode.

24. An image forming apparatus according to claim 19, further comprising a copy mode, a facsimile mode, and a print mode, wherein a tray is selected in accordance with each of the modes and discharged sheets are stacked thereon, and a number of said spacer trunnions for each of the spaces between said trays is differentiated from one another, so that capacity of sheet stacking of each of said trays is differentiated from one another.

* * * * *